US008408845B2

(12) United States Patent
Hutchinson

(10) Patent No.: US 8,408,845 B2
(45) Date of Patent: Apr. 2, 2013

(54) PEDESTAL SUPPORT FOR MINE PROP

(75) Inventor: Thomas L. Hutchinson, Fairmont, WV (US)

(73) Assignee: Swanson Industries, Inc., Morgantown, WV (US)

( * ) Notice: Subject to any disclaimer, the term of this patent is extended or adjusted under 35 U.S.C. 154(b) by 61 days.

(21) Appl. No.: 13/087,924

(22) Filed: Apr. 15, 2011

(65) Prior Publication Data

US 2012/0263546 A1 Oct. 18, 2012

(51) Int. Cl.
*E21D 15/58* (2006.01)

(52) U.S. Cl. ..... 405/288; 299/11; 248/357

(58) Field of Classification Search ..... 405/288, 405/289, 290; 299/11, 12; 248/357; 52/292, 52/296, 297
See application file for complete search history.

(56) References Cited

U.S. PATENT DOCUMENTS

| | | | | | |
|---|---|---|---|---|---|
| 1,818,633 | A | | 8/1931 | Levin | |
| 2,029,789 | A | | 2/1936 | Parks | |
| 3,188,041 | A | * | 6/1965 | Town | 405/288 |
| 3,317,188 | A | * | 5/1967 | Linscott et al. | 248/357 |
| 3,329,402 | A | * | 7/1967 | Grumman | 248/357 |
| 3,689,017 | A | * | 9/1972 | Harvey | 248/357 |
| 3,988,870 | A | * | 11/1976 | Snavely | 52/297 |
| 4,830,543 | A | * | 5/1989 | Joubert | 405/229 |
| RE34,220 | E | | 4/1993 | Kennedy et al. | |
| 5,308,196 | A | | 5/1994 | Frederick | |
| 5,400,994 | A | * | 3/1995 | Shawwaf et al. | 405/290 |
| 5,538,364 | A | * | 7/1996 | Huntsman | 405/288 |
| 5,785,459 | A | * | 7/1998 | Swinimer | 405/229 |
| 5,819,487 | A | * | 10/1998 | Bull et al. | 52/296 |
| 5,832,675 | A | * | 11/1998 | Zuares | 52/296 |
| 6,056,480 | A | * | 5/2000 | Kolk | 405/288 |
| 6,256,961 | B1 | * | 7/2001 | Byrnes | 52/296 |
| 6,910,834 | B2 | | 6/2005 | Harbaugh et al. | |
| 2002/0136607 | A1 | * | 9/2002 | Merz | 405/288 |
| 2003/0121223 | A1 | * | 7/2003 | Riker | 52/296 |

* cited by examiner

*Primary Examiner* — Frederick L Lagman
(74) *Attorney, Agent, or Firm* — Spillman Thomas & Battle, PLLC

(57) ABSTRACT

A pedestal support for a mine prop. The pedestal support includes a collar to dispose a mine prop at least partially therein and a yielding member extending from the collar. The yielding member includes a wall having a top edge and a bottom edge and having a thickness that tapers from the top edge to the bottom edge and that flares from the top edge to the bottom edge.

21 Claims, 4 Drawing Sheets

PEDESTAL SUPPORT FOR MINE PROP

FIELD OF THE INVENTION

This invention relates to roof supports, and more particularly to a yielding complement for mine props.

BACKGROUND OF THE INVENTION

In mining, after the mineral or strata is removed, providing some method of supporting the newly exposed roof is required. In mechanized mining, the majority of exposed roof is supported quickly by the application of roof bolts, mechanical devices which are inserted in holes drilled in the exposed mine roof. These roof bolts serve to tie the layers of strata together to form a self-supporting beam from the layers of roof rock. However, there is still some considerable need for the use of supplementary roof supports or "timbers". The term "timbering" has the generic meaning of installing some direct support between the mine roof and floor regardless of the material from which it is made.

The supplementary supports have several uses and may be used to shore up and to prevent the spread of deteriorating roof strata which occurs from time to time in various places in a mine. Also, mine openings or entries (which are similar to tunnels) which are no longer used may be timbered as a preventive measure to avoid deterioration some time in the future.

However, a major use of supplementary supports is to maintain the roof in entries used as access to and around longwall mining sections or pillar extraction sections of a mine. In such locations, open entries are needed to allow air flow or access for inspection and therefore, considerable extra effort, in the form of supplemental support, is expended to maintain such entries.

Supplementary supports may be non-yielding or rigid in the form of wooden posts placed in a vertical orientation (perpendicular to the roof and floor), steel posts or stacked concrete blocks. Such non-yielding props have a distinct disadvantage in that they may fail catastrophically and with little warning when the force from the converging roof exceeds the strength of the prop. In such a situation, once the rigid support has failed, there may be less resistance remaining to prevent the roof from falling-in further. In addition, such rigid supports may tend to cause the roof and floor to deteriorate due high stresses imposed at the points of contact.

Another form of supplementary support is the yielding type. Given that the mine roof always is slowly converging (or settling), the yielding prop will give way to the roof's movement while not failing. In this manner, the prop continues to function as it is intended by providing support to the roof at a prescribed force. A well-designed yielding support could have characteristics including: a) it exerts consistent force through its operating range, b) it operates through a reasonably long effective range, c) its intended supporting force is not affected by storage or atmospheric conditions that may exist in a mine and d) it may be rapidly deployed by mine personnel.

There are numerous yielding props available including those which depend upon a friction force to develop resistance, those which depend upon a formulated cementaceous compound to crush at a prescribed force and those utilizing a regulated hydraulic pressure to yield at the prescribed force.

Many of the above mentioned products require special equipment, large crews of personnel and considerable set-up time to begin the installation process. The installed cost of such units may be quite high, a factor that cannot be overlooked in the cost-competitive mining industry.

As provided herein, the present invention presents a yielding support providing a steady and predictable support force throughout its entire range of operation and one which is easily stored and deployed for use with minimal personnel requirements.

In addition to mining applications, such supports may be utilized to support structures in other than mining situations.

SUMMARY OF THE INVENTION

In one embodiment, a pedestal support for a mine prop includes a collar configured to dispose a mine prop at least partially therein and a yielding member extending from the collar and having a central longitudinal axis. The yielding member may include a wall with an exterior surface, an interior surface, a top edge, and a bottom edge. The exterior surface may extend from the top edge to the bottom edge with a pitch angled outward from said central longitudinal axis. The interior surface may extend from the top edge to the bottom edge with a pitch angled outward from the central longitudinal axis. The pitch angle of the exterior surface may be less than the pitch angle of the interior surface.

In another embodiment, a pedestal support for a mine prop includes a collar to dispose a mine prop at least partially therein and a yielding member extending from the collar and having a wall with a top edge and a bottom edge. The wall may have a thickness that tapers from the top edge to the bottom edge.

An additional embodiment of the pedestal support includes a collar including a bottom edge, a ledge extending from the bottom edge of the collar, and a yielding member that has an interior surface, an exterior surface, a top edge, and a bottom edge. The yielding member may have a top edge and bottom edge thickness each determined by the distance between the exterior surface and interior surface. In this embodiment, the top edge thickness may be greater than the bottom edge thickness, and the top edge may be a distance from the bottom edge such that the cross sectional area between the interior surface and exterior surface remains substantially constant between the top edge and bottom edge.

Other embodiments, which may include one or more parts of the aforementioned method or systems or other parts, are also contemplated, and may thus have a broader or different scope than the aforementioned method and systems. Thus, the embodiments in this Summary of the Invention are mere examples, and are not intended to limit or define the scope of the invention or claims.

BRIEF DESCRIPTION OF THE DRAWINGS

The accompanying drawings, wherein like reference numerals are employed to designate like components, are included to provide a further understanding of the pedestal support, and are incorporated in and constitute a part of this specification, and illustrate embodiments of the pedestal support that together with the description serve to explain the principles of the pedestal support.

Various other objects, features and advantages of the invention will be readily apparent according to the following description exemplified by the drawings, which are shown by way of example only, wherein.

DETAILED DESCRIPTION

Reference will now be made to embodiments of the pedestal support, examples of which are illustrated in the accompanying drawings. Details, features, and advantages of the pedestal support will become further apparent in the following detailed description of embodiments thereof.

Figure 1:
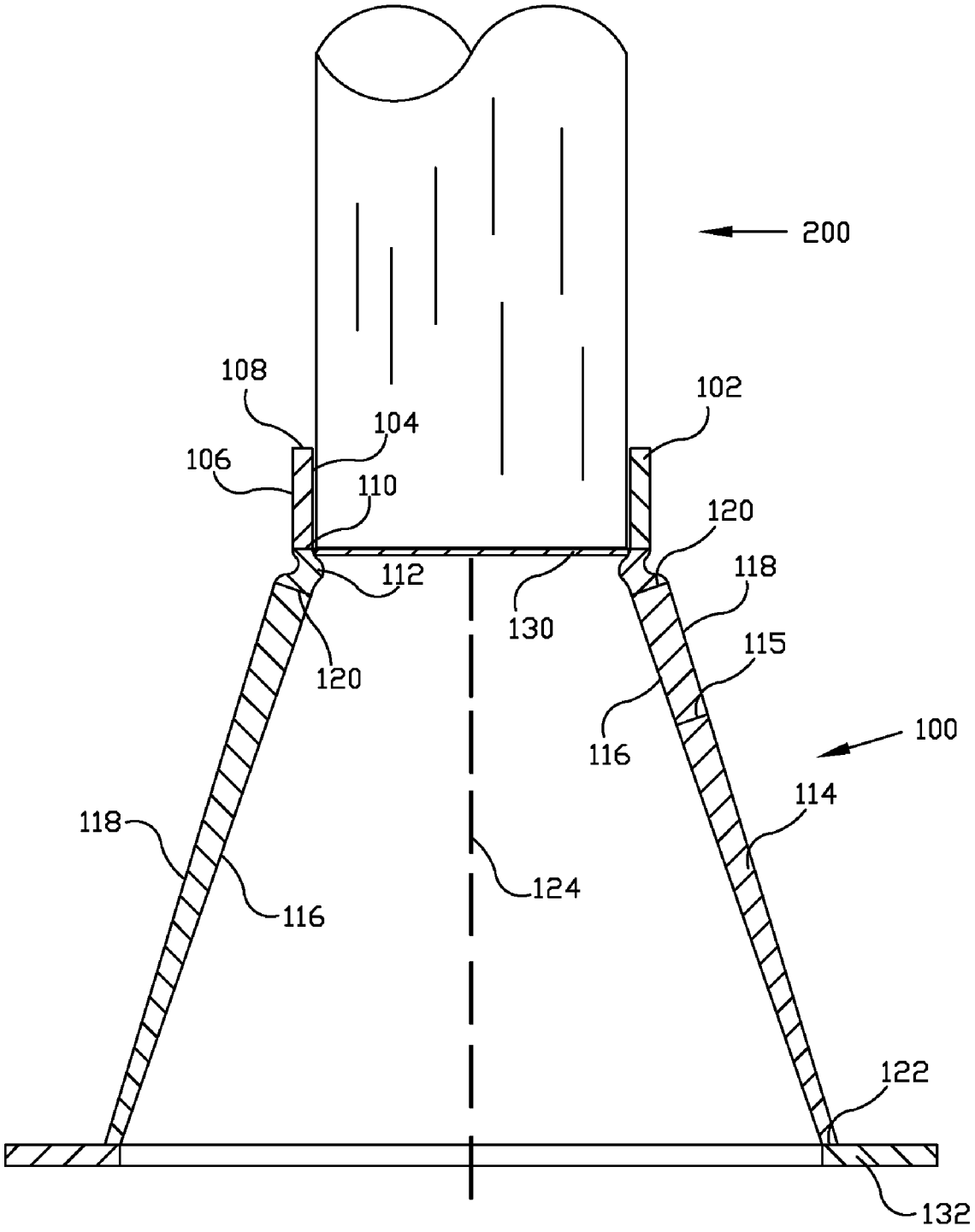
FIG. 1 illustrates a cross-sectional view of the pedestal support.

FIG. 1 illustrates an embodiment of a pedestal support 100 for a mine prop 200, which may be columnar in one embodiment. The pedestal support 100 includes a collar 102 having an interior surface 104, an exterior surface 106, a top edge 108, and a bottom edge 110. The interior surface 104 may be sufficiently sized for disposing a mine prop 200 at least partially therein. The mine prop 200 may be made of wood or steel or any material suitable for carrying a load, such as supporting a mine roof. The cross sectional shape of the mine prop 200 may be circular, square, or any other shape suitable for carrying a load. The collar 102 may be endless in that the interior surface 104 and exterior surface 106 each form a continuous perimeter. It should also be understood that the collar 102 may have open ends in an embodiment and still allow the mine prop 200 to be disposed within the perimeter of the collar 102.

The perimeter of the interior surface 104 may be variously dimensioned (with various sizes and shapes) in different embodiments such that different dimensions of the mine prop 200 can be disposed within. For example, in one embodiment, the perimeter of the interior surface 104 can be dimensioned such that its perimeter provides a friction fit with the mine prop 200. In that embodiment, the collar 102 may have a cylindrical interior surface 104 having a diameter that is slightly smaller than the exterior diameter of a mine prop 200 that is columnar to provide the friction fit. In an alternative embodiment, the collar 102 may have a cylindrical interior diameter defined by the interior surface 104 that is larger than that of the exterior diameter of the mine prop 200 to allow for an amount of play in the fitting between the collar 102 and mine prop 200. In other embodiments, the collar 102 may have its interior surface 104 variously dimensioned dependent on the dimensions of the surface of the mine prop 200 to fit the mine prop 200 at least partially therein with or without play.

Figure 2:
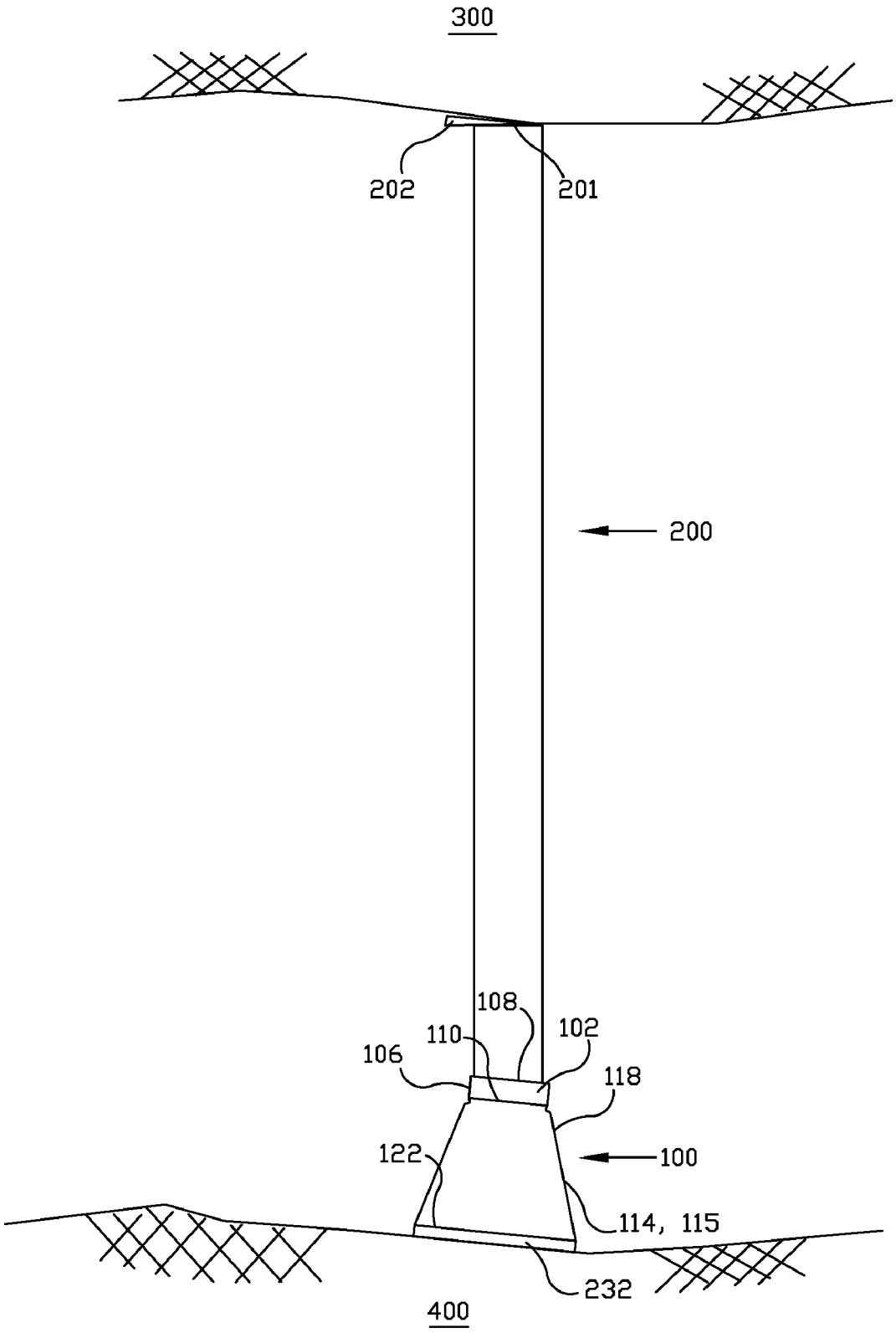
FIG. 2 illustrates a side view of the pedestal support in use.

FIG. 2 illustrates an embodiment of the pedestal support 100 in use. In FIG. 2, the pedestal support 100 has the mine prop 200, which is columnar in this embodiment, disposed partially within it. In this embodiment, the mine floor 400 is an irregular surface and is not parallel with the mine roof 300. It may be desired in one embodiment, however, in order to increase the efficiency of the load carrying capacity of the pedestal support 100 and mine prop 200, that if possible, the pedestal support 100 sit substantially flush with the mine floor 400 and the mine prop 200 be substantially flush with the mine roof 300. As shown in FIG. 2, the play in the fitting between the collar 102 and the mine prop 200 may allow for use in a configuration where the floor is uneven and/or the floor and ceiling are not parallel. Thus, the central axis of the mine prop 200 may be positioned approximately perpendicular to the mine roof 300 such that the top surface 201 of the mine prop 200 is substantially flush therewith, while the bottom edge 122 of the yielding member 114 (or the bottom of the lip 132 or 232, if included) of the pedestal support 100 may be substantially flush with the mine floor 400. The play in the joint between the collar 102 and mine prop 200 may thus allow both the pedestal support 100 and mine prop 200 to have significant contact with the mine roof 300 and mine floor 400, respectively, increasing the efficiency of the load transfer from the mine roof 300 to the mine floor 400.

In addition, or alternatively, to increase contact when the mine roof 300 is uneven and/or the mine roof 300 and mine floor 400 are nonparallel, a shim 202 may be positioned between the mine roof 300 and top surface 201 of the mine prop 200. A shim (not shown) may also or alternatively be positioned between the mine floor 400 and pedestal support 100, such as when the mine floor 400 is uneven. In another embodiment, a combination of using one or more shims and having play in the joint between the collar 102 and mine prop 200 may be used, as shown in FIG. 2.

A shim 202, when acting as a wedge, may be positioned in any case between the mine roof 300 and the top surface 201 of the mine prop 200. Such positioning may effect a preliminary load on the mine prop 200 that may prevents the prop from toppling over and provide immediate support to the roof strata.

In one embodiment such as shown in FIG. 1, the collar 102 includes a ledge 112 extending from its bottom edge 110 and adjacent to the interior surface 104. In another embodiment, the ledge 112 may extend from a portion of the interior surface 104 that is not coincident with the bottom edge 110. The ledge 112 may be dimensioned as desired to restrict the mine prop 200 from passing through the collar 102. For example, in various embodiments, the ledge 112 may extend various distances from the interior surface 104 to provide a bottom support for the mine prop 200, and may or may not be endless.

In another embodiment, the pedestal support 100 may include a base 130 instead of a ledge 112. In this embodiment, the base 130 may be integral with, secured to, or otherwise positioned adjacent to the collar 102. The base 130 may act as a support for the bottom of the mine prop 200.

In another embodiment, the ledge 112 and base 130 may both be included, and the ledge 112 may support the base 130, such as shown in FIG. 2. The base 130 may, in turn, support the mine prop 200.

Connected to the collar 102 is the yielding member 114. The yielding member 114 may assume the load transferred from the mine roof 300 through the mine prop 200 and yield before the mine prop 200 in an embodiment. As described below, this yielding may be more steady and predictable than in that of certain other mine props, reducing the chance of catastrophic failure.

The yielding member 114 may include a wall 115 having an interior surface 116, an exterior surface 118, a top edge 120, and a bottom edge 122. The thickness of the wall 115 at the top edge 120 may be greater than the thickness of the wall 115 at the bottom edge 122. The thickness of the wall 115 of the yielding member 114 may, in an embodiment, taper from the top edge 120 to the bottom edge 122. Thus, the thickness of the wall 115 may be less the further away from the top edge 120.

The wall 115 may flare, and thus the interior surface 116 and exterior surface 118 may each extend outward, away from the central longitudinal axis 124 of the yielding member 114, as they extend from the top edge 120 to the bottom edge 122 such as shown.

In one embodiment, the degree to which the thickness of the yielding member 114 wall 115 tapers, and thus the angles that the interior surface 116 and exterior surface 118 extend outward with respect to the central longitudinal axis 124 as they extend from the top edge 120 to the bottom edge 122, are such that the cross sectional area of the yielding member 114 remains substantially constant between the top edge 120 and bottom edge 122, where the cross sectional area is taken perpendicular to the central longitudinal axis 124.

In one embodiment, the shape of the yielding member 114 is at least partially a hollow conical frustum. However, the yielding member 114 may at least partially take the shape of any hollow frustum in another embodiment. As used herein, a "hollow frustum" is a shape having its exterior surface delineating a frustum, but hollow. The interior and exterior surfaces of the hollow frustum need not necessarily be parallel. Thus, the yielding member 114 may be at least partially shaped as a hollow frustum, notwithstanding that its interior surface 116 is not parallel to its exterior surface 118, i.e., their angles with respect to the central longitudinal axis 124 are different.

In an embodiment, the exterior surface 118 of the wall 115 may extend from the top edge 120 to the bottom edge 122 with a pitch angled outward from the central longitudinal axis 124. The interior surface 116 may also extend from the top edge 120 to the bottom edge 122 with a pitch angled outward from the central longitudinal axis 124. The aforementioned pitch angle of the exterior surface 118 may be less than the pitch angle of the interior surface 116. Thus, the interior surface 116 may extend a greater difference in distance away from the central longitudinal axis 124 as it extends from the top edge 120 to the bottom edge 122 than does the exterior surface 118.

In an embodiment in which the collar 102 includes the ledge 112, the ledge 112 may be adjacent to the interior surface 116 of the yielding member 114 if desired. The ledge 112 may extend between the interior surface 104 of the collar 102 and the interior surface 116 of the yielding member 114.

The yielding member 114 may be formed of a material, such as steel, that will mechanically deform when placed under a predetermined load, such as the load of a mine roof 300. By having a substantially constant cross sectional area, as in one embodiment as described above, the yield may be more gradual, and thus more steady than in some other designs. In an embodiment, the yielding member 114, and thus the pedestal support 100, may yield before the mine prop 200 under the load from the mine roof 300 transferred through the mine prop 200. The yield of the yielding member 114 may be closer to constant, and thus more steady and predictable, than that of a reinforced and bolted wood prop without the pedestal support 100. As a result, the mine roof 300 may more steadily and predictably descend and the mine prop 200 may be able to continue to support the load of the mine roof 300.

Figure 3:
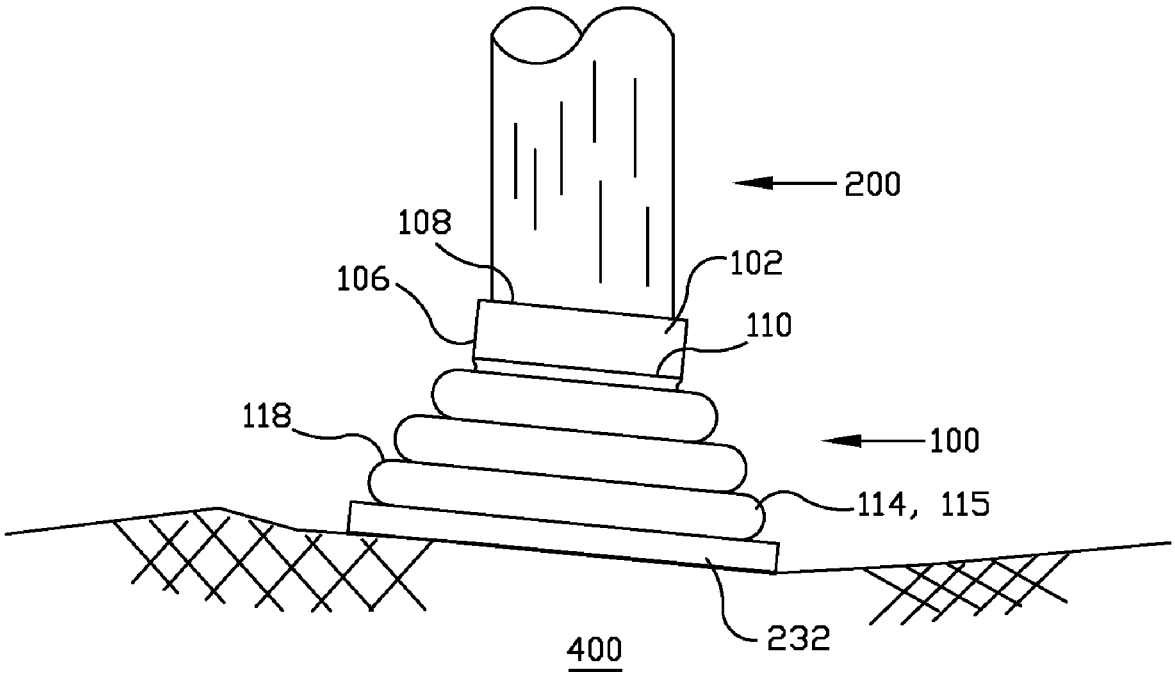
FIG. 3 illustrates a side view of the pedestal support in its yielded state.

In one embodiment, the pedestal support 100 includes a lip 132. The lip 132 may extend from the bottom edge 122 of the wall 115. The lip 132 may extend in a direction substantially perpendicular to the central longitudinal axis 124 of the yielding member 114. In another embodiment, the pedestal support 100 includes a lip 232, such as shown in FIG. 3 described below, that extends from the bottom edge 122 of the wall 115. However, in this other embodiment, the lip 232 extends in a direction substantially parallel to the central longitudinal axis 124 of the yielding member 114. The lip 132 or 232 may extend at a different angle, if desired, and may turn such that it extends in more than one direction. In various embodiments, the lip 132 or 232 may be endless such that it extends entirely around the bottom edge 122 of the wall 115, or may not be endless and/or may include multiple parts. The lip 132 or 232 may contribute to stabilizing the pedestal support 100 against tipping over.

FIG. 3 illustrates an embodiment of the pedestal support 100 once it has begun to yield from the transferred load of the mine roof 300. The steadier yield may provide for an accordion-like mechanical deformation of the yielding member 114.

In various embodiments of the yielding member 114, the thickness of the top edge 120 and bottom edge 122 of the yielding member 114 and the degree of taper and angles in which the interior surface 116 and exterior surface 118 extend away from the central longitudinal axis 124 as they extend from the top edge 120 to the bottom edge 122 vary according to the desired load capacity and the yielding point. Furthermore, the perimeter of the collar 102 can vary according to the desired load rating of the mine prop 200. One way of identifying the yield and load rating of the pedestal support 100 is to have the rating printed on the pedestal support 100. Alternatively, the size of the collar 102 perimeter can be used to indicate the corresponding mine prop 200 of a given rating that will fit within the collar 102, thus indicating the pedestal rating.

Since the yielding member 114 may be of a singular construction, in one embodiment, that is separate from the mine prop 200, any deterioration, rust, or deformation of the mine prop 200 may not affect the yielding characteristics of the pedestal support 100. As a result, the yielding characteristics of the yielding member 114 may remain substantially consistent within the mine environment.

Figure 4:
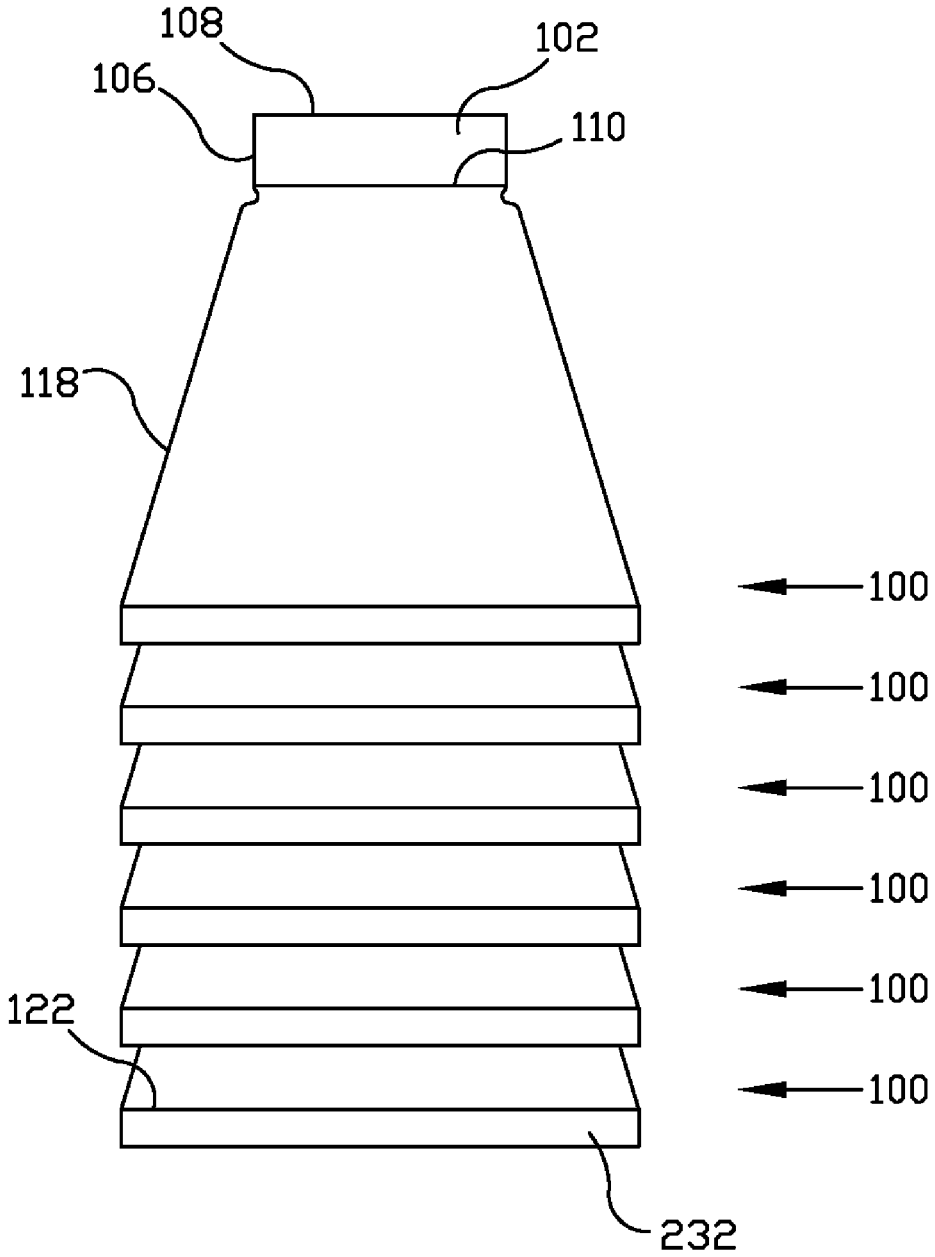
FIG. 4 illustrates a side view of multiple pedestal supports stacked on top of each other.

In one embodiment as shown in FIG. 4, pedestal supports 100 are stackable. In this embodiment, a first pedestal support 100 may be placed over a second pedestal support 100 such that the second will be disposed partially within the first. Thus, the bottom edge 110 (or ledge 112, if included) of the first pedestal support 100 collar 102 may rest against the top edge 108 of the second pedestal support 100 collar 102. Further, the interior surface 116 of the first pedestal support 100 may or may not rest at least partially in contact with the exterior surface 118 of the second pedestal support 100. As a result, many pedestal supports 100 can be stacked on top of each other such that they nest together and provide an efficient means for storage and transportation.

While specific embodiments of the invention have been described in detail, it should be appreciated by those skilled in the art that various modifications and alternations could be developed in light of the overall teachings of the disclosure. Accordingly, the particular arrangements, apparatuses, systems, and methods disclosed are meant to be illustrative only and not limiting as to the scope of the invention.

What is claimed is:

1. A pedestal support for a mine prop, comprising:

a collar to dispose a mine prop at least partially therein; and a yielding member extending from said collar and having a central longitudinal axis, said yielding member comprising a wall having an exterior surface, an interior surface, a top edge, and a bottom edge, said exterior surface extending from said top edge to said bottom edge with a pitch angled outward from said central longitudinal axis, said interior surface extending from said top edge to said bottom edge with a pitch angled outward from said central longitudinal axis, said pitch angle of said exterior surface less than said pitch angle of said interior surface.

2. The pedestal support of claim 1, further comprising a ledge comprising a bottom edge, the ledge extending from said bottom edge of said collar.

3. The pedestal support of claim 2, further comprising a base, said base supported by said ledge.

4. The pedestal support of claim 1, further comprising a base positioned adjacent to said collar.

5. The pedestal support of claim 1, wherein said yielding member comprises steel.

6. The pedestal support of claim 1, said wall having a substantially constant cross sectional area perpendicular to said central longitudinal axis.

7. The pedestal support of claim 6, said yielding member providing a steady support force throughout its range of operation and deforming at a force that is less than the force required to deform a mine prop to be disposed on the yielding member.

8. The pedestal support for claim 1, wherein said mine prop is columnar.

9. The pedestal support of claim 1, wherein said yielding member is at least partially shaped as a hollow frustum.

10. The pedestal support of claim 1, wherein said yielding member is a least partially shaped as a hollow conical frustum.

11. The pedestal support of claim 1, further comprising a lip extending from said bottom edge of said wall.

12. The pedestal support of claim 1, wherein said interior surface of said collar is cylindrical.

13. A pedestal support for a mine prop, comprising:

a collar to dispose a mine prop at least partially therein; and a yielding member extending from said collar and comprising a wall having a top edge and a bottom edge, said wall having a thickness that tapers from said top edge to said bottom edge.

14. The pedestal support of claim 13, said wall flaring.

15. The pedestal support of claim 13, wherein said yielding member is at least partially shaped as a hollow frustum.

16. The pedestal support of claim 13, wherein said yielding member is at least partially shaped as a hollow conical frustum.

17. The pedestal support of claim 13, further comprising a lip extending from said bottom edge of said wall.

18. The pedestal support of claim 13, said collar comprising a bottom edge, said pedestal support further comprising a ledge extending from said bottom edge of said collar.

19. The pedestal support of claim 18, further comprising a base, said base supported by said ledge.

20. The pedestal support of claim 18, said pedestal support shaped so as to be stackable such that said pedestal support may be positioned over a second pedestal support such that the second pedestal support is disposed partially within the pedestal support, said ledge of said pedestal support resting against a top edge of said second pedestal support.

21. A pedestal support for a mine prop comprising, a collar comprising a bottom edge;

a ledge extending from said bottom edge of said collar; and a yielding member extending from said collar, the yielding member having an interior surface, an exterior surface, a top edge, and a bottom edge, said yielding member having a top edge thickness determined by the distance between said exterior surface and said interior surface, said yielding member having a bottom edge thickness determined by the distance between said exterior surface and said interior surface, said top edge thickness being greater than said bottom edge thickness, said top edge being a distance from said bottom edge such that the cross sectional area of said yielding member remains substantially constant between said top edge and said bottom edge.

* * * * *